US006545268B1

(12) United States Patent
Verentchikov et al.

(10) Patent No.: US 6,545,268 B1
(45) Date of Patent: Apr. 8, 2003

(54) PREPARATION OF ION PULSE FOR TIME-OF-FLIGHT AND FOR TANDEM TIME-OF-FLIGHT MASS ANALYSIS

(75) Inventors: Anatoli Verentchikov, Boston, MA (US); Jennifer M. Campbell, Somerville, MA (US)

(73) Assignee: PerSeptive Biosystems, Framingham, MA (US)

( * ) Notice: Subject to any disclaimer, the term of this patent is extended or adjusted under 35 U.S.C. 154(b) by 0 days.

(21) Appl. No.: 09/546,465

(22) Filed: Apr. 10, 2000

(51) Int. Cl.[7] ..... H01J 49/26; H01J 49/40

(52) U.S. Cl. ..... 250/287; 250/281; 250/280

(58) Field of Search ..... 250/281, 282, 250/287

(56) References Cited

U.S. PATENT DOCUMENTS

| | | | | |
|---|---|---|---|---|
| 4,963,736 | A | 10/1990 | Douglas et al. | |
| 5,073,713 | A | * 12/1991 | Smith et al. | 250/282 |
| 5,117,107 | A | 5/1992 | Guilhaus et al. | |
| 5,202,563 | A | 4/1993 | Cotter et al. | |
| 5,206,508 | A | 4/1993 | Alderdice et al. | |
| 5,569,917 | A | 10/1996 | Buttrill et al. | |
| 5,625,184 | A | 4/1997 | Vestal et al. | |
| 5,627,360 | A | 5/1997 | Rudeen | |
| 5,627,369 | A | 5/1997 | Vestal et al. | |
| 5,760,393 | A | 6/1998 | Vestal et al. | |
| 5,763,878 | A | 6/1998 | Franzen | |
| 6,107,623 | A | * 8/2000 | Bateman et al. | 250/282 |
| 6,323,482 | B1 | * 11/2001 | Clemmer et al. | 250/287 |
| 6,326,615 | B1 | * 12/2001 | Syage et al. | 250/287 |
| 6,331,702 | B1 | * 12/2001 | Krutchinsky et al. | 250/281 |
| 6,348,688 | B1 | * 2/2002 | Vestal | 250/287 |
| 6,441,369 | B1 | * 8/2002 | Vestal et al. | 250/287 |

FOREIGN PATENT DOCUMENTS

| | | |
|---|---|---|
| WO | WO91/03071 | 8/1989 |
| WO | WO98/06481 | 8/1997 |
| WO | WO99/30350 | 12/1998 |
| WO | WO99/39368 | 1/1999 |

OTHER PUBLICATIONS

Krutchinsky, A.N. et al., "Orthogonal Injection of Matrix–assisted Laser Desorption/Ionization Ions into a Time–of–Flight Spectrometer Through a Collisional Damping Interface", Rapid Communications in Mass Spectrometry, 12, 508–518 (1998).

Verentchikov, A. et al., "Collisional Cooling and Ion Formation Processes in orthogonal MALDI at Intermediate Gas Pressure", Proc. 47th ASMS Conference on Mass Spectrometry and Allied Topics, Dallas, TX Jun. 13–17, 1999.

Kofel et al., "Matrix–assisted Laser Desorption/Ionization Using a New Tandem Quadrupole Ion Storage Trap, Time–of–flight Mass Spectrometer", Rapid Communications in Mass Spectrometry, vol. 10, 658–662 (1996).

(List continued on next page.)

*Primary Examiner*—John R. Lee
*Assistant Examiner*—David A. Vanore
(74) *Attorney, Agent, or Firm*—Andrew T. Karnakis

(57) ABSTRACT

The use of a segmented-ion trap with collisional damping is disclosed to improve performance (resolution and mass accuracy) of single stage and tandem time-of-flight mass spectrometers. In the case of single stage spectrometers ions are directly injected from a pulsed ion source into the trap supplied with RF field and filled with gas at millitorr pressure. Subsequently, the ions are dynamically trapped by an RF-field, cooled in gas collisions and ejected out of the trap by a homogeneous electric field into a time-of-flight mass spectrometer. In the case of tandem mass spectrometric analysis the pulsed ion beam is injected into a time-of-flight analyzer to select ions-of-interest prior to injection into the trap at medium energy to achieve fragmentation in the trap.

34 Claims, 6 Drawing Sheets

OTHER PUBLICATIONS

Doroshenko et al., "A Quadrupole Ion Trap/Time–of–flight Mass Spectrometer with a Parabolic Reflectron", Journal of Mass Spectrometry, vol. 33, 305–318 (1998).

Krutchinsky et al., "Collisional Damping Interface for an Electrospray Ionization Time–of–Flight Mass Spectrometer", American Society for Mass Spectrometry, 1998, 9, 569–579.

Westmacott, et al., "Measurements of Ion Yield vs. Laser Fluence Using Orthogonal–injection MALDI/TOF with Collisional Cooling and Single–ion Counting", Proc. 46th ASMS Conference on Mass Spectrometry and Allied Topics, Orlando, FL, Jun. 1–5, 1998.

Michael et al., "An ion trap storage/time–of–flight mass spectrometer" Review of Scientific Instruments 63 (10), Oct. 1992, pp. 4277–4284.

Thomson et al., "Improved Collisionally Activated Dissociation Efficiency and Mass Resolution on a Triple Quadrupole Mass Spectrometer System", Analytical Chemistry, vol. 67, No. 10, May 15, 1995, pp. 1696–1704.

Qian, et al., "Procedures for Tandem Mass Spectrometry on an Ion Trap Storage/Reflectron Time–of–flight Mass Spectrometer", Rapid Communications in Mass Spectrometry, 10, pp. 1911–1920 (1996).

Morris, et al., "High Sensitivity Collisionally–activated Decompsoition Tandem Mass Spectrometry on a Novel Quadrupole/Orthogonal–acceleration Time–of–flight Mass Spectrometer", Rapid Communications in Mass Spectrometry, vol. 10, 889–896 (1996).

Campbell et al., "A New Linear Trap Ion Trap Time–of–flight System with Tandem Mass Spectrometry Capabilities", Rapid Communications in Mass Spectrometry, 12, 1463–1474 (1998).

Ji et al., "A Segmented Ring, Cylindrial Ion Trap Source for Time–of–Flight Mass Spectrometry," Journal of the American Society of Mass Spectrometry, 7, pp. 1009–1017 (1996).

Juhasz et al., "On the Initial Velocity of Ions Generated by Matrix–Assisted Laser Desorption Ionization and its Effect on the Calibration of Delayed Extraction Time–of–Flight Mass Spectra", Journal of the American Society for Mass Spectrometry, 1997, 8, 209–217.

* cited by examiner

PREPARATION OF ION PULSE FOR TIME-OF-FLIGHT AND FOR TANDEM TIME-OF-FLIGHT MASS ANALYSIS

FIELD OF INVENTION

This invention relates generally to mass spectrometry, in particular to a novel apparatus and method to prepare an ion pulse for ideal analysis in a time-of-flight mass spectrometer and in tandem mass spectrometers in which fragments are analyzed via time-of-flight mass spectrometry.

BACKGROUND OF THE INVENTION

Mass spectrometers are devices which vaporize and ionize a sample and then determine the mass to charge ratios of the collection of ions formed. One well known mass analyzer is the time-of-flight mass spectrometer (TOFMS), in which the mass to charge ratio of an ion is determined by the amount of time required for that ion to be transmitted, under the influence of pulsed electric fields, from the ion source to a detector. TOFMS has become widely accepted in the field of mass spectrometry, having the desirable attributes of high scan speed, high sensitivity, theoretically unlimited mass range, and, if an ion mirror is used, achievable resolutions of greater than 10,000. The spectral quality in TOFMS reflects the initial conditions of the ion beam prior to acceleration into a field free drift region. Specifically, any factor which results in ions of the same mass having different kinetic energies, and/or being accelerated from different points in space, will result in a degradation of spectral resolution, and thereby, a loss of mass accuracy. High mass accuracy is a desirable property in spectrometers used in the analysis of biomolecules, as it is one of the important factors in the unambiguous determination of peptide, and thereby protein, identity using database searching.

Two instrumental developments which minimize the effects of spatial and energy spreads on the final spectra are prevalent in the field. The first is the two-stage, or Wiley-McLaren, acceleration source, which provides first order space focusing, and the second is the ion mirror, or reflectron, which provides first order energy focusing. Additionally, the two widely adopted methods to produce gas phase biomolecular ions for mass spectrometric analysis, namely matrix assisted laser desorption ionization (MALDI) and electrospray ionization (ESI), have integrated certain instrumental attributes which have enhanced spectral resolution. The development of delayed extraction (DE) for MALDI-TOF as described in U.S. Pat. Nos. 5,625,184, 5,627,369 and 5,760,393 has made high resolution routine for MALDI based instruments. For ESI-TOFMS, high resolutions have been achieved by transmitting the ion beam through an RF only quadrupole and into the acceleration region of a TOFMS. The accelerating pulse is applied perpendicular to the direction of transmission. For both these methods, however, the resolution enhancement is not achieved without sacrificing another element of instrumental performance.

In DE-MALDI, a short delay is added between the ionization event, triggered by the laser, and the application of the accelerating pulse to the TOF source region. The fast (i.e., high-energy) ions will travel farther than the slow ions, in effect transforming the energy distribution upon ionization to a spatial distribution upon acceleration. A Wiley-McLaren source is used for space focusing. The delay time in DE-MALDI, however, can only optimize performance across a narrow range of mass to charge ratios, hence, resolution varies across the spectrum and calibration is non-linear. Additionally, the performance of the spectrometer is strongly coupled to the energy distribution from the ionization source. The highest mass resolution is achieved using so-called "threshold" conditions, i.e., operating the laser at the minimal fluence that yields observable ionization. If laser fluence is increased beyond this threshold value, ions are formed with a broader energy distribution, thereby degrading spectral quality.

It is known in the art that raising the laser fluence substantially above the threshold value increases the number of ions formed per laser pulse by orders of magnitude. As a consequence, in DE-MALDI the resultant direct coupling of the ionization source with the spectrometer is manifested in a tradeoff between resolution and sensitivity, that is one cannot simultaneously optimize conditions for ionization and mass analysis. An independent problem in MALDI based spectrometers is the observation, in some instances, of spectral features resultant from decay of ions during their flight time from the acceleration source region to the detector. Briefly, if ions created in the MALDI process are formed with excess internal energy, ions may dissociate prior to detection. The resulting fragments appear in the spectrum as unassignable chemical noise, "metastable" peaks, and/or increased background in the spectrum.

In a spectrometer equipped with an ESI source, a method termed orthogonal acceleration (oa) TOFMS is typically used. In oa-TOFMS, the ionization source may be separated from the acceleration region of the TOFMS by an RF-only quadrupole operating in the millitorr pressure regime. This quadrupole acts as a beam guide transmitting ions formed at atmosphere into the vacuum regions of the spectrometer. As described in U.S. Pat. No. 4,963,736, the passage of an ion beam through an RF-only quadrupole operated in the millitorr pressure regime leads to the "collisional cooling" of the beam. Through sequential collisions between the ion and the background gas, the internal energy of the ions is lowered to approach that of the background gas (i.e., the ion beam becomes thermalized). Similarly, the translational kinetic energy of the beam is lowered, restricting the motion of the ions to the low field region of the quadrupolar potential, resulting in a narrow beam of ions and more efficient transmission through restrictive ion optics. Lastly, reduction of the translational kinetic energy of ions coaxial to the beam, results in a denser beam with a smaller translational energy spread. As collisional cooling lowers the internal energy of the ions formed, harsh ionization conditions can be used without degrading spectral resolution and thus in an oa-TOFMS the ionization source becomes effectively decoupled from the spectrometer. The oa-TOFMS has been coupled to a MALDI ionization source, operated with a high repetition rate, high fluence Nd:YAG laser OPO 5000, as described by Anatoli Verentchikov et al. "Collisional Cooling and Ion Formation at Intermediate Gas Pressure", Proc. 47$^{th}$ ASMS Conference on Mass Spectrometry and Allied Topics, 1999, to create a quasi continuous beam which is pulsed into the TOFMS.

A key element of oa-TOFMS is that the beam enters the acceleration region of the TOFMS orthogonal to the direction the pulse is accelerated. (see U.S. Pat. No. 5,117,107 and Dodonov USSR Patent No. SU 168134A1 and published PCT application WO91/03071). Thus, the initial conditions of the accelerated TOF pulse are defined by the properties of collisional cooling in a quadrupolar potential, i.e., the ions have small spatial and energy distribution. One limitation in oa-TOFMS is that the duty cycle of the instrument, which is defined as the ratio of the time required to fill the acceleration region of the TOF spectrometer to the time for mass analysis, is typically a low 5–20%. A further disadvantage of oa-TOFMS is that the ions of the accelerated pulse maintain a small velocity component in the direction perpendicular to TOF acceleration. Therefore the ion pulse accelerated in the TOF has a natural "drift" angle which must be compensated for, either through the use of a large detector surface or an electrostatic steering deflector, a device which is known in the art to degrade resolution.

The problem of poor duty-cycle in oa-TOFMS has been addressed in a combination, or "hybrid" instrument in which the continuous ion beam is stored in a quadrupole ion trap and ejected as discrete pulses into the TOFMS by Mark Q. Qian et al. "Procedures for Tandem Mass Spectrometry on an Ion Trap/Reflection Time-of-Flight Mass Spectrometer", Rapid Communications in Mass Spectrometry, 10, 1996. According to the authors, careful synchronization of the emptying of the trap and the TOF analysis can be used to achieve a near 100% instrumental duty cycle. With few exceptions, these systems use a commercial ion trap with a conventional geometry for both storage and creation of the TOFMS acceleration field electrodes. The use of the trap geometry for ion extraction is problematic, as the trap electrodes create a non-linear electric field, while optimal TOFMS operation, requires a linear electric field. Two references, U.S. Pat. No. 5,569,917 and published PCT Application WO 99/39368, discuss novel combinations of extraction voltages that can be used in conjunction with the conventional ion trap geometry to create and improve ion pulses for TOFMS. In each case, however, reference is made to using differential extraction voltages to compensate for higher order fields in the trap itself and neither reference demonstrates the resolution of either oa-TOFMS or DE-TOFMS systems. Existing work on MALDI-trap TOFMS, as described by Peter Kofel et al. "Matrix Assisted Laser Desorption/Ionization Using a New Tandem Quadrupole Ion Storage Trap, Time-of-Flight Mass Spectrometer", Rapid Communications in Mass Spectrometry, 19, 1996, has demonstrated that as the electric field in the center of the quadrupolar potential is substantially linear, ions are sufficiently collisionally cooled.

The issue of a poor extraction field in ion trap TOFMS systems has been addressed by the use of a segmented ring ion trap (see, for example, Qinchung Ji et al. "A Segmented Ring, Cylindrical Ion Trap Source for Time-of-Flight Mass Spectrometry", Journal of the American Society of Mass Spectrometry, 7, 1996) the purpose of which was to couple an electron impact source to a TOFMS with a 100% duty cycle. In this instrument the "trap" was created by four simple ring electrodes, operated such that an oscillating field which is substantially quadrupolar was created. Ions are trapped in the field formed by the rings for a set period of time. At the end of the trapping period, the RF potential is rapidly switched off and a unidirectional, linear field in the (former) trapping volume is actualized by applying DC pulses to the rings, the magnitudes of which are proportional to the distance from that electrode to the source plate. Resolution attained on this TOFMS, however, was not optimal. Although an ideal extraction field was claimed to be formed, the position and energy of the ions at the time the field was applied was found to be strongly dependent on the phase of the quadrupolar potential at the instant the RF power supply was switched off. Ions that are moving in the direction opposite to that of the TOFMS accelerating field required a "turn around" time during extraction and this additional time degraded the spectral resolution. Also, the phase dependent spread in kinetic energies resulted in the necessity to use a reflectron that was specially designed to accommodate ions with a large velocity spread.

The performance of existing hybrid ion trap-TOFMS instruments has been substantially limited by the following factors:

- Initial trapping of the ion beam is inefficient due to the necessity to overcome the barrier created by the rapidly oscillating quadrupolar potential. A significant portion of ions formed will be lost in the injection process unless the ions are formed within the trapping volume.
- When a continuous ion beam is used, only those ions that have, through collisions with the background gas, lost sufficient translational kinetic energy to be confined in the quadrupolar potential will have stable trajectories in the ion trap. Consequently trapping efficiency is low.
- The conventional electrode geometry of the three-dimensional ion trap has a relatively low space charge capacity. If, for example, more than 1000 ions are confined in 1 $mm^3$, energy gained from inter-ion repulsion will result in the ions having a translational kinetic energy, which is greater than thermal energy, thereby lowering TOF resolution. For typical trap operating conditions of 1 millitorr of helium, full collisional cooling requires approximately 30 ms. Thus, to maintain ions at thermal energies, total throughput of the system must be below $3\times10^4$ ions per second, a value which is not adequate for most applications.
- In order for ions to be stored effectively, typically 1 millitorr of helium is present in the trap. However, since the same volume is used for storage and acceleration, during acceleration ions may undergo numerous collisions which alters the ideal trajectories in the TOF analyzer. Additionally, in the three-dimensional ion trap, the combination of poor confinement of the ion beam and the non-linear acceleration field result in a wide ion cloud to extract; therefore, to enhance sensitivity a large extraction aperture is used between the trap and TOFMS. This raises the pressure in the flight tube and thereby increases both the number of collisions which transpire and the load on the vacuum pumps in the flight tube.

Another broad application of mass spectrometry is tandem mass spectrometry, denoted MS/MS. An MS/MS instrument provides the capability to isolate an ion based on its mass to charge ratio, fragment the selected ion, and mass analyze the fragments. Spectra from MS/MS instruments are used to provide information on the structure and bond strength of the precursor ions (sometimes called parent ions). Additionally, through reducing the amount of chemical noise, MS/MS machines actually improve the spectral signal to noise ratio and hence the detection limit of the precursor ions.

The ability of TOFMS to provide parallel analysis of all mass components is used in multiple tandem instruments, classified as hybrid TOFMS. The most common of these hybrid instruments combines quadrupole and TOF technology, often referred to as QqTOFMS. An example of a QqTOFMS has been described by Howard R. Morris et al. "High Sensitivity Collisionally-activated Time-of-Flight Mass Spectrometer", Rapid Communications in Mass Spectrometry, 10, 1996. This instrument is constructed from two tandem quadrupoles and an orthogonally situated TOFMS. The first quadrupole, a mass filter, is used for precursor ion selection; fragmentation is precipitated via sequential low energy collisions with an inert gas in an RF-only quadrupole operating in the millitorr regime. The resultant fragment ions are analyzed by an oa-TOFMS. Increasing precursor selection resolution in the mass filter results in decreasing sensitivity, thus achievement of unit resolution is only possible with significant ion losses. Consequently, resolution is compromised in most analytical applications, and the above discussed problems of the second oa-TOFMS, namely poor duty cycle and a drift velocity orthogonal to the TOF axis, also affect performance.

The ion trap TOFMS, can also be operated as a hybrid tandem TOF instrument. In MS/MS mode, during storage precursor ions are isolated and fragmented in a quadrupole ion trap and the contents are analyzed by TOFMS. As the processes of ion isolation and fragmentation are based upon the principles of resonant excitation, the ion traps in such instruments must provide well defined, and near ideal, quadrupolar electric fields. Thus the conventional three-dimensional ion trap electrode geometry operated with a background pressure of 1 millitorr helium is required. The disadvantages of this configuration for TOF analysis were discussed above.

In another hybrid TOF instrument used for MS/MS analysis, the three-dimensional ion trap is replaced with a linear, or two-dimensional, ion trap, (orthogonal to the direction of TOF acceleration) as detailed in published PCT Applications WO 99/30350 and WO 98/06481 and demonstrated by J. M. Campbell et al., as reported in "A New Linear Ion Trap Time-of-Flight System with Tandem Mass Spectrometry Capabilities", Rapid Communications in Mass Spectrometry, 12, 1998. In the linear ion trap, ions are confined by a quadrupolar potential in two dimensions and by electrostatic potentials in the third dimension. Thus electrostatic, rather than oscillating quadrupolar, potentials control the flow of ions into and out of the trap and the processes of injection and extraction are both simpler to implement and more efficient than in the three dimensional ion trap. Additionally, the linear ion trap provides a larger trapping volume and thus an enhanced ion storage capacity over the three-dimensional trap. In the above PCT applications, ions were injected into the TOF through coupling lenses. In U.S. Pat. No. 5,763,878, the concept of extracting ions from the linear ion trap through a gap in the rod structure is described, and reference is made to the advantage such a concept would provide for TOF analysis in an oa-TOFMS system. However, the instrument described in this patent suffers from a slow cycle of ion selection and fragmentation in the first MS stage as well as the problems discussed above for all oa-TOFMS.

Another method of TOF based MS/MS analysis uses TOF mass analyzers for both precursor ion selection and fragment ion analysis. U.S. Pat. No. 5,206,508 discusses a TOF/TOF system without a mechanism for precursor ion isolation. A second patent, U.S. Pat. No. 5,202,563, discloses a TOF/TOF system with two reflecting-type mass analyzers coupled via a fragmentation chamber. Lastly, co-pending U.S. patent application Ser. No. 09/233,703, commonly assigned as with the present application, describes a TOF/TOF system and includes a detailed description of a timed ion selector (TIS) used to attain high resolution ion selection with a TOF based system. An instrument based on this patent has been used to record fragment spectra on a wide selection of ions, including biomolecules. This TOF/TOF system has been named a double DE system. Ions are formed in a region with a DE-MALDI source, the precursor ions are selected by the timed ion selector and transmitted to the collision cell. The resultant collection of precursor and fragment ions is transmitted into a second TOF acceleration region. At the time that the ions of interest are near the center of the second source, a high voltage pulse is applied, and the ions are accelerated toward the detector. Varying the time of application of the second acceleration pulse creates the second nominal DE system, through which the resolution of the fragment ion spectra can be optimized.

Various effects limit attainable performance of TOF/TOF instruments (mass accuracy and resolution). Analogous to DE-MALDL the energies and positions of fragment ions entering the second source are dependent on mass to charge ratios. As the velocities of ions entering the second acceleration region of a TOF/TOF spectrometer are orders of magnitude greater than those extracted from a matrix in a standard DE source, limitations known in the art for DE-MALDI (e.g., non-linear calibration) are magnified in the TOF/TOF instrument. Consequently, uniform-focusing conditions cannot be attained across the entire mass range, limiting high resolution (and mass accuracy) to a narrow window of fragment ion masses. In addition, optimization of the resolution in the second MS is strongly dependent on conditions in the first MS, which complicates tuning of the instrument. Furthermore, ions which gain internal energy through collisions, but for which the kinetics of dissociation are such that fragments form during transmission in the field free region of the second TOF, appear as metastable ions in the spectrum, resulting in chemical noise and unassignable spectral features.

In spite of the numerous efforts in the past as reflected by the development of various instruments outlined above, there still is not an apparatus and method that simultaneously addresses all of the ideal requirements of TOF and tandem TOF analyses. For example, the need still exists for an MS instrument wherein final spectral quality is decoupled from the mechanism of ionization, such that conditions that provide maximum instrumental sensitivity (e.g., high laser fluence) can be used without sacrificing spectral quality. Furthermore, if harsh ionization conditions are used, a technique for "cooling" ions that are typically formed with sufficient internal energy to fragment, may be needed within the ion source, such that the spectral degrading effects of metastable fragmentation are suppressed. Ideally, resolution and accuracy should be uniform across the mass range and mass calibration should be linear. Lastly, a 100% duty cycle should be achieved with both pulsed and continuous ionization sources. In addition to the aforementioned desired features, MS/MS analysis using tandem TOF instruments ideally should possess the ability to decouple operation of both the first TOF and second TOF MS stages.

SUMMARY OF THE INVENTION

The present inventors have realized that the combined use of dynamic trapping and collisional cooling in a segmented ion trap operating at appropriate gas pressure provides a simple and effective method to prepare an ideal pulse for TOF analysis. In doing so, this invention addresses issues such as instability of ions, poor initial conditions, dependence on laser energy and /or ion losses at the time of ion pulse formation, which heretofore have been a significant limitation of TOFMS. Additionally, the invention addresses problems with respect to the issues of injection into and extraction from an ion storage volume to a time-of-flight mass analyzer. The present invention exhibits a high degree of flexibility and can be implemented in numerous existing TOF systems with MALDI and ESI ion sources, and can be used to substantially improve existing TOF/TOF systems. The invention is also adaptable to various hybrid systems with TOF as a final mass analyzer.

In a preferred embodiment, the invention includes a pulsed ion source (MALDI source or ESI source with a storing and pulsing multipole ion guide), a segmented ion trap filled with gas at about millitorr pressure, and a TOF analyzer. Ions from the source are injected into and dynamically trapped in the ion trap, collisionally confined to the center of the trap and subsequently extracted as a pulse into the TOF analyzer.

Briefly, one preferred embodiment of the invention, as implemented in a single stage TOFMS, operates as follows:

(1) Stable ions are formed using a known ionization mechanism, such as MALDI, ESI, thermospray, ICP, FAB, APCI, etc. sources, that are either pulsed or continuous in nature.

(2) The ions are pulse injected into a segmented ring trap. If MALDI is used, the ionization source could be located external to the trap in a region operated at a higher pressure than the trap. If ESI is used, the ions can be stored in an external ion guide, and pulsed into the segmented ring ion trap.

(3) The ions are trapped via dynamic trapping. The ions are initially confined in the segmented ring trap by rapidly switching on or ramping up a high voltage RF power supply. The applied RF potential creates a quadrupolar field confining the ions in two or three dimensions. In the instance of two-dimensional quadrupolar trapping, the ions are confined in the third dimension through electrostatic potentials.

(4) The ions are velocity damped via collisions with a neutral gas. The subsequent lowering of the ion translational energy will confine ions to the low field (i.e., center) region of the quadrupolar potential.

(5) The ions are pulse extracted from the segmented ring trap and into a TOFMS. This process is accomplished by rapidly switching off the RF potential, and rapidly (e.g., within ~100 ns) applying an extraction potential to the ring electrodes of the trap. The extraction potential is linear and unidirectional, applying to each ring a pulse, the magnitude of which is proportional to the distance from that ring to the first ring electrode.

(6) A pulsed, high voltage, acceleration stage is adjacent to the trapping electrodes, and is differentially evacuated to operate at a pressure intermediate from that of the trap and the TOF flight tube.

(7) The extracted ions are analyzed via the TOFMS. To attain optimal resolution the TOF analyzer is equipped with an ion mirror.

One of the key elements of the invention is a use of a segmented ion trap. Unlike conventional ion traps with hyperbolic-shaped electrodes, a segmented ion trap utilizes multiple planar electrodes. When appropriate RF potentials are applied to these planar electrodes, an approximate quadrupolar field is generated resulting in confinement of ions. During ion extraction, the RF field is turned off and a unidirectional, linear field is achieved through application of suitable DC potentials to the planar electrodes. The invention utilizes two types of segmented trap: a three-dimensional trap, formed by ring electrodes and a two-dimensional trap, also termed 'linear segmented trap', formed by parallel flat plates. Both types of segmented trap are applicable for all the examples discussed below, and the specific type used is selected based on technical conveniences.

The segmented ion trap is used for trapping, storing, cooling and pulsed ejection, but not employed for isolation, excitation, and/or mass analysis. Consequently, there is no need to establish and maintain well defined ion trajectories in the quadrupolar field in the trap. The parameters of the system embodied by the invention can thus be optimized for pulse preparation for TOFMS. In doing so, various aspects of the invention provide numerous advantages and overcome the following problems of the known trap-TOF systems:

Inefficient collisional trapping of a continuous ion beam is replaced by a dynamic trapping of a pulsed ion beam.

Stabilization of ions can be improved when desired by lowering internal energy in gas collisions in the ion source. Gas collisions also lower kinetic energy of ions and thus improve efficiency of dynamic trapping in the segmented trap.

Confinement of ions in the trap can be improved by the use of a smaller size trap and the selection of a stronger RF field at a higher frequency, which allows a broad mass range of ions to be stable in RF field. The optimization becomes possible since the trap is used exclusively for storage and there are no requirements to select and control RF frequencies to maintain precise ion trajectories as imposed by resonant excitation techniques.

For certain applications, the space charge limitation can be reduced by the use of a two dimensional trap, low mass cut off in the trap, and a higher repetition rate of pulsed extraction.

The gas load on the TOF system can be reduced by using pulsed gas introduction into the trap or into the ion source and by the introduction of an additional differentially pumped acceleration stage.

The quality of TOF spectra (resolution and mass accuracy) can be improved by the better confinement of the ion beam, the absence of beam defocusing in a uniform accelerating field, and a low probability of gas collisions during acceleration and within a TOF flight tube.

One preferred embodiment provides a system with collisional stabilization of MALDI generated ions at an intermediate gas pressure with a subsequent pulsed injection into the next differentially pumped stage where ions are dynamically trapped in a segmented trap, wherein the ions are stabilized, confined, and pulse ejected into the TOF. In one particular implementation, the trap is a two dimensional segmented trap and pumping of the analyzer is improved by an additional pumping stage between the trap and the TOF. Both axial and orthogonal coupling geometries with the TOFMS are viable options for this embodiment. Collisional cooling in the source (i.e., prior to the confinement and acceleration region) allows the use of a high repetition and/or high energy laser to enhance sensitivity of analysis. Analyzer performance is decoupled from source conditions, resulting in improved, uniform resolution and a linear calibration.

In one embodiment of the invention, the gas is introduced into the source region via a pulsed valve to reduce gas load on vacuum pumps and to provide a lower gas pressure for ion ejection. In another embodiment of the invention, the gas is similarly introduced into the trap via a pulsed valve and ions are formed in the same differentially pumped stage. In yet another embodiment of the invention, an infrared laser is used to produce initially stable ions and gas pressure is reduced to the minimum sufficient for ions confinement. It is known in the art that use of an infrared laser with MALDI results in the formation of an excessive number of weak complexes with the matrix. Broadband excitation in, or heating of, the trap could be used to break these complexes and provide cleaner peaks of molecular ions.

In another preferred embodiment, the trap/TOF pulse preparation stage is coupled to an ESI source with a modulating multipole ion guide. The trap in this embodiment is a linear two-dimensional segmented trap to allow a wide range of masses to be trapped, thereby substantially increasing the space charge capacity of the trap. The trap is connected to the TOF analyzer via an intermediate, differentially pumped stage. The ion beam is fully utilized, providing a 100% duty cycle. The drift component of ion velocity is essentially eliminated and ions are injected into the TOF parallel to the axis.

The invention further encompasses the use of dynamically trapped, collisionally cooled ion preparation as part of a tandem TOF system. The precursor ions are injected into a trap with the energy desired for collisional dissociation. In one embodiment, the injected pulsed beam is dynamically trapped, undergoes fragmentation in earlier collisions and the resulting collection of fragment and precursor ions are collisionally cooled in the trap. Thus, the event which promotes the increase in internal energy necessary for fragmentation (e.g., collisions with a surface or a background gas), the trapping electrodes, and the background neutral gas are in a common volume, and activation and dissociation occur simultaneous with trapping. In another embodiment of the invention, the precursor ions are activated (i.e., their internal kinetic energy is increased) by surface induced dissociation (SID). The fragment ions formed in the SID process sequentially bounce off the surface, are dynamically trapped by the RF field and then are slowly damped in gas collisions. In both aforementioned embodiments, the use of dynamic trapping to efficiently capture the ion pulse allows the gas pressure in the trapping volume, and thus the mass analyzer, to be reduced. Consequently there will be fewer scattering collisions during both ejection into, and flight through, the mass analyzer, thereby allowing higher resolution to be achieved.

The invention provides a significant improvement of beam characteristics in front of the second TOFMS, since kinetic energy is damped in gas collisions and ions are confined to the center of the trap. As a result, the resolution is improved, linear calibration is achieved, and operation of the analyzer is decoupled from the ionization source.

Briefly, a preferred embodiment of the system for tandem TOF instruments operates as follows:

(1) A pulsed ion beam is formed from a MALDI or ESI source.

(2) A precursor ion is selected. In this embodiment the method of selection is a linear TOF equipped with a timed ion selector. In order to increase resolution of selection, a reflecting system can be employed.

(3) The ions are decelerated to the desired injection energy. In this manner, there is control of the energy available for the activation event, trapping is ensured, and ions of different mass but identical velocity to the precursor are filtered prior to entering the fragmentor volume.

(4) The precursor ions are pulse injected into a fragmentor. The fragmentor could contain a surface for SID (such as a gold surface with a monolayer of an organic known to promote efficient conversion of translational kinetic energy to internal energy) and/or a relative high pressure ($1\times10^{-2}$ to $1\times10^{-4}$ torr) neutral gas for CID. In either instance some fraction of the ion population rapidly (e.g., in 1 $\mu$s to 1 ms) dissociates into fragment ions.

(5) The collection of activated precursor and fragment ions in the fragmentor is dynamically trapped and collisionally cooled for a fixed time frame as described above with respect to the TOF-only method. For tandem mass spectrometry applications, the trapping time is varied considering both the needs for collisional cooling and precursor dissociation kinetics.

(6) The contents of the fragmentor are extracted into the second TOFMS for fragment analysis using a uniform pulsed electric field.

(7) The fragments are mass analyzed by the second TOFMS as described above.

In one preferred embodiment, a folded geometry is employed, and the same mass analyzer is used for both MS1 and MS2. The beam is formed in a pulsed source and is passed through the orifice of an annular detector. The beam is reflected in an electrostatic mirror at a small angle to the TOF axis. Precursor ions are selected with high resolution in a timed ion selector and enter the collisonal cell, equipped with a segmented ion trap. Fragments are trapped, cooled, and ejected into the same TOF analyzer but in the reverse direction. After being reflected in the mirror the ions hit the detector. This embodiment of the invention provides an inexpensive and compact solution for TOF—TOF instruments.

The invention summarized above addresses the limitations in TOF analysis as previously described. In particular, confining the ions in a collisional environment between the source and the pulsing necessary for TOF analysis provides a period of relaxation such that excess internal energy may dissipate prior to analysis. This will "cool" the internal temperature of the ions, lowering the rate of thermal decomposition, and thereby minimizing metastable fragmentation and the spectral noise associated with it. The combined use of a quadrupolar field, with collisional cooling, will result in the spatial localization of the low energy ions in the center of the electrode structure, thereby creating perfect initial conditions for extraction into the TOF analyzer. In addition, confining the ions to the center of the field will minimize the spatial spread of the extracted ions, largely eliminating the correlation between mass resolution and phase at the time of extraction. The segmented ring geometry provides an electrode geometry that can be used to create both a quadrupolar and an accelerating field. Additionally there should not be ion losses in the extraction phase. The present invention is presented as a general apparatus and method for preparing an ideal pulse for TOF analysis, and is easily adaptable to existing configurations of instruments.

BRIEF DESCRIPTIONS OF THE DRAWINGS

This invention is pointed out with particularity in the appended claims. The above and further advantages of this invention may be better understood by referring to the following description taking in conjunction with the accompanying drawings, in which:

DETAILED DESCRIPTION OF THE INVENTION

Figure 1A:
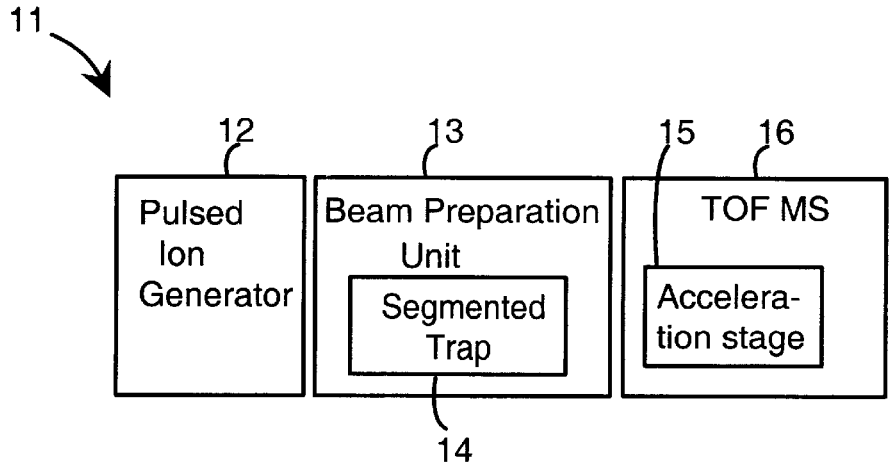
FIG. 1A is a block diagram of one embodiment of the invention for use in TOFMS.

Referring to FIG. 1A, in brief overview, a time-of-flight mass spectrometer 11 in accordance with the present invention includes a pulsed ion generator 12, a beam preparation unit 13, which includes a segmented ion trap 14, and a TOFMS 16, which includes a differentially pumped acceleration region 15. In operation, a pulse of stable ions is formed in the pulsed ion generator, then injected into the trap, dynamically trapped and collisionally cooled in the segmented ion trap at a sub-millitorr gas pressure. After a sufficient time frame for the trapped ion cloud to adopt the characteristics of an ideal pulse for TOF analysis, the ions are accelerated out of the trap and into the TOFMS for analysis.

Figure 1B:
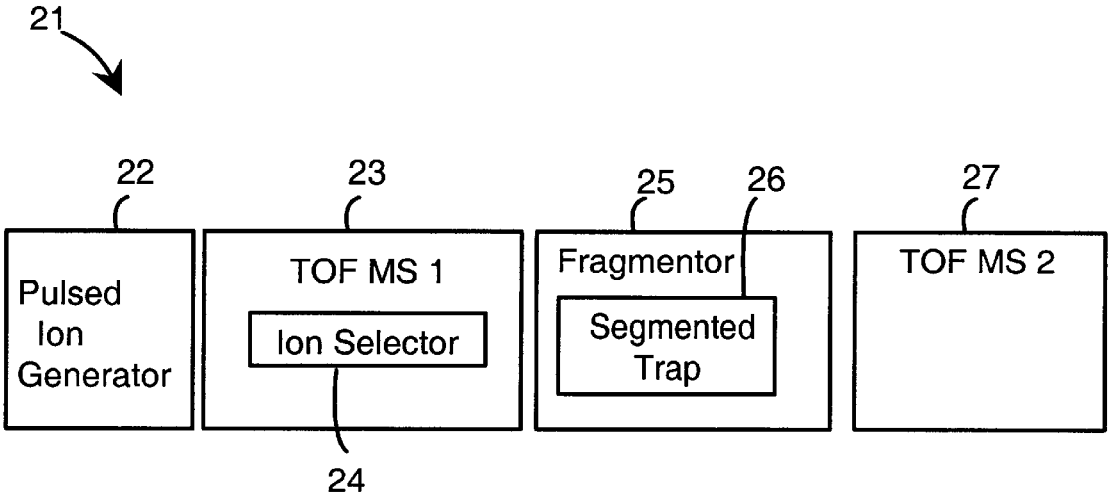
FIG. 1B is a block diagram of another embodiment of the invention for use in TOF-TOF MS.

Referring to FIG. 1B, in brief overview, the present invention further encompasses a tandem time-of-flight mass spectrometer 21, including a pulsed ion generator 22, a first TOF MS 23 with a timed ion selector 24, a fragmentor 25, containing a segmented trap 26, and a second TOFMS 27. In operation, ions are formed in the pulsed ion generator and accelerated into the first TOFMS towards the timed ion selector. Selected ions traveling with a uniform velocity (roughly corresponding to a few keV energy) are decelerated at the entrance into the trap, such that ions of a single mass to charge ratio enter the fragmentor, while metastable fragments (having lower energy) are deflected/defocused. Mass-selected ions enter the trap at a desired energy (e.g., ~50 eV for 1 kDa precursor ion) and may either be subjected to collision induced dissociation (CID) or surface induced dissociation (SID). The resulting fragments and remaining precursor ions are trapped in the volume of the segmented trap. After trapping for an adequate time frame such that both an adequate number of fragments are created and fragment ions are collisonally confined to the axis of the trap (i.e., a suitable pulse for TOF analysis is formed), the collection of remaining precursor and fragment ions are accelerated into the second TOFMS.

Both the single and tandem TOFMS embodiments briefly described above employ the same principle of ion pulse preparation prior to TOF analysis, namely the dynamic trapping of the ion beam in the segmented trap followed by collisional cooling, preferably at low pressure, and pulsed ion ejection out of the segmented ion trap.

In more detail, and referring to FIG. 2, one preferred embodiment is shown for the application of the invention to a MALDI TOFMS 31 system. The pulsed ionization source 32 contains a laser 33, a sample plate 34, and a pulsed gas inlet system 35. The ionization source is located a short distance (typically 1 to 3 mm) away from the first electrode plate 36A of the segmented ring ion trap 36. The trap is connected to a set of RF and pulsed power supplies 37. The trap is in communication with the TOF 39 via an electrostatic acceleration stage 38. All stages are differentially evacuated by a set of vacuum pumps 40.

Figure 2A:
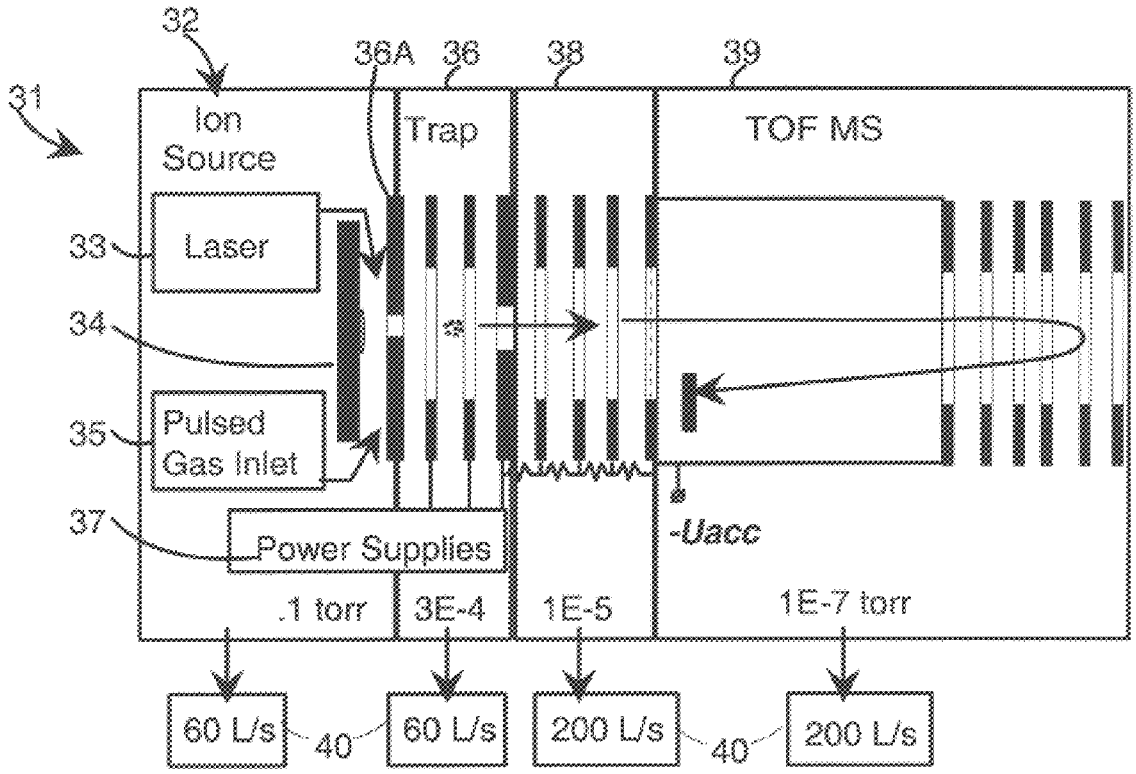
FIG. 2A is a schematic of one embodiment of the invention for use in MALDI-TOFMS.
Figure 2B:
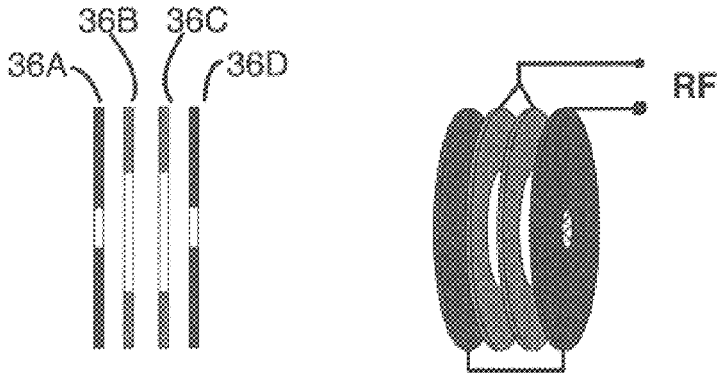
FIG. 2B is a schematic and accompanying three dimensional view of a segmented ring trap used in the embodiment of FIG. 2A.
Figure 3A:
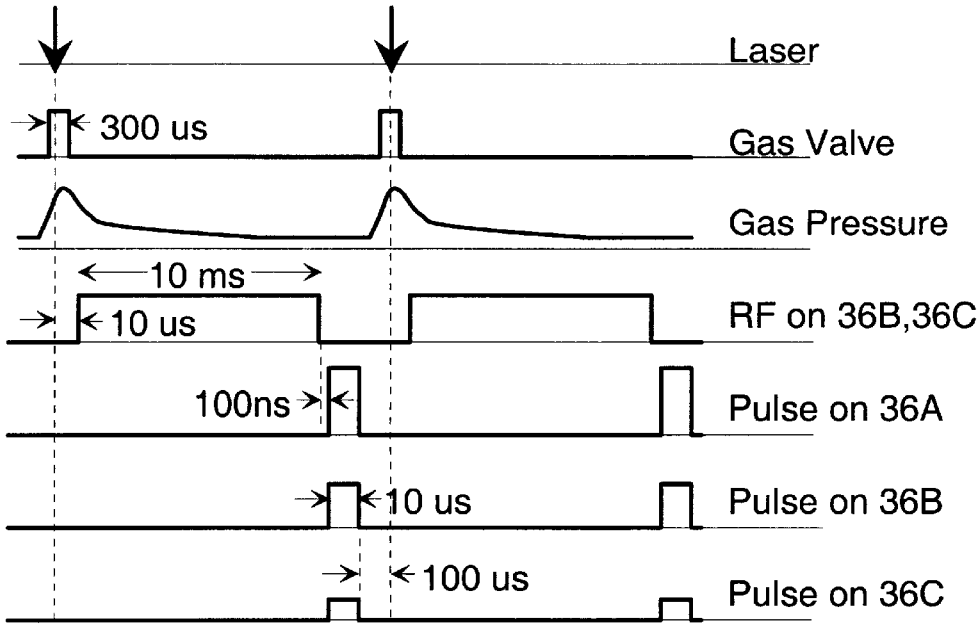
FIG. 3A is a timing diagram of the operation of the trap used in the embodiment of FIG. 2A.
Figure 3B:
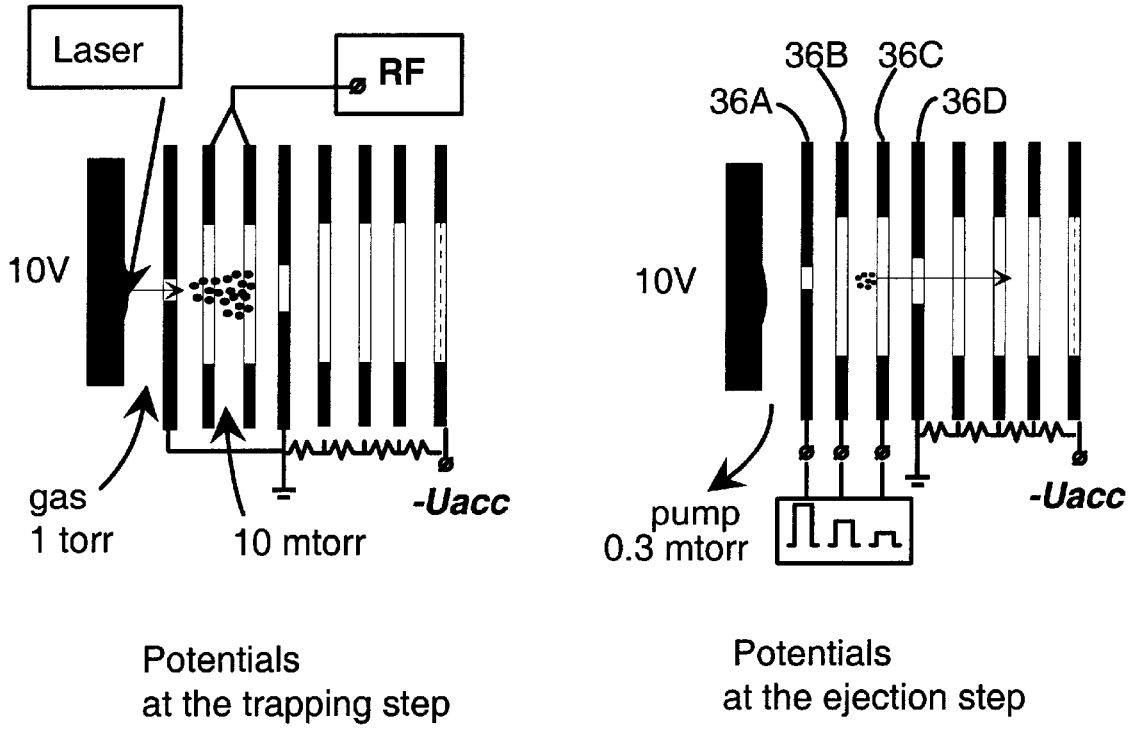
FIG. 3B is a graphical representation of the voltages present during ion trapping and ion ejection from a segmented trap for the embodiment shown in the FIG. 3A.

FIG. 2B presents a schematic and three dimensional view of the segmented trap. In order to achieve optimum ion injection, confinement, and extraction, the trap 36 in this embodiment is formed by four electrically isolated rings 36A to 36D. Details on the operation of the trap as well as timing and voltages on each component are shown in FIG. 3A and 3B. By altering the voltages applied to the rings, these electrodes can be used to create the electric fields required for both ion confinement and unidirectional extraction. For ion trapping, the rings form a three-dimensional quadrupolar field, similar to that of the three-dimensional segmented trap described in the above mentioned Ji et al. publication. The first 36A and last 36D of the four rings are grounded and middle two electrodes 36B and 36C are connected to an RF power supply. An important aspect of the invention is that at the ejection step the potentials applied to the electrodes rapidly (e.g., about 100 ns) switch from a configuration which confines the ions to a unidirectional, linear acceleration field (FIG. 3B). The magnitude of the extracting pulses applied to the rings are proportional to their distance from the first end cap (36D).

In operation, and referring to FIGS. 2A, 2B, 3A and 3B, the pulsed laser fluence (energy per unit area) is adjusted so that the laser pulse produces a burst of ions. Ions are ejected from the sample plate with initial velocities of 300 to 700 m/s, depending upon the matrix used. Using a pulsed gas inlet, the ion source 32 is synchronously filled with gas to a pressure of ~1 torr. The internal energy of the ions is rapidly cooled in gas collisions in the source. Ions are rapidly (~1 to 10 $\mu$s) transferred into the trap by weak electric fields and by diffusive flow between the source (<10 millitorr) and the trap (~0. 1 millitorr). As ions approach the center of the trap, the RF voltage is turned on (or ramped up) and subsequently ions are dynamically trapped. Ions gradually (typically in ~10 ms) lose their kinetic energy in collisions with the background gas and thus move to the center of the trap, creating a "cold" and well-confined ion pulse tailored for subsequent TOF analysis. At the time the pulse is ready for extraction, the gas is evacuated by a turbo pump to a pressure below 0.3 millitorr thus scattering collisions during acceleration are avoided. The RF voltage is rapidly switched off and electric pulses are applied to the trap electrodes such that a uniform unidirectional electrostatic field is created for injecting ions into the TOF mass spectrometer.

The invention provides for the parallel optimization of multiple parameters which are key to final spectral quality, which include the following:

- Collisional cooling in the ion source;
- Optimal geometry of trap electrodes;
- Simultaneous dynamic trapping of a broad mass range;
- Selection of optimal parameters of the applied potential for beam confinement;
- Consideration of the degradation of TOF resolution by space charge in the trap;
- Cooling and pulsing rate in the trap;
- Gas load on pumping system and scattering collisions in the trap and in the TOF;
- Limited mass range of the trap-TOF MS.

One important aspect for certain applications of the invention is stabilization of ions in the ion source and prior to injection into the segmented trap. Ions generated in a MALDI process have a relatively large internal energy, which can lead to metastable dissociation, usually observed in TOFMS on a 10 to 100 $\mu$s time scale. In one embodiment of the present invention, collisions between ions and neutral gas introduced into the ion source at 1 torr pressure lead to rapid (~1 $\mu$s) dissipation of internal energy, thereby stabilizing the ions and minimizing metastable fragmentation. Alternatively, instead of supplying a gas, stable ions can be formed with the use of an infrared laser. In this case, the ion source can operate at ~1 millitorr, i.e., the same pressure as the ion trap.

The configuration shown in FIG. 2A permits a very high laser irradiance, which is known in the art to increase the number of ions produced by orders of magnitude. Therefore, a high repetition rate, high-energy laser, for example, an Nd-YAG laser at 355 nm wavelength, is preferred. Several kHz repetition rate of the Nd-YAG laser improves speed and sensitivity of analysis compared to commercial MALDI instruments equipped with a low repetition rate N2 laser and typically operating at repetition rate below 20 Hz. Collisional cooling in the source and the confinement in the trap provide a complete decoupling between ion production and TOF analysis. Therefore, strong variations in the ion source do not affect TOF performance and the mild ionization properties of the method. Such variations may include non-conductive substrates, rough crystals, volatile matrices, outgasing gels, or tissues.

The injection into the trap should be rapid, soft and 100% efficient. Ions are transmitted from the ionization source 32 with a low kinetic energy, regulated by the energy offset between the sample plate 34 and the trap 36. Ion neutral collisions during this process should be of sufficiently low energy to avoid ion dissociation, thus, for typical operating conditions the injection energy must be substantially lower than 50 eV/kDa. Complete ion sampling into the trap is ensured by a relatively large solid angle in the sampling aperture (1 mm diameter at ~1 to 3 mm distance), by a transmitting electric field, and by diffusive flow into the lower pressure trapping region.

For dynamic trapping it is important to maintain all mass components in the trap at similar velocities. The MALDI process itself is known in the art to eject ions of all masses at the same velocity (300 to 700 m/s, depending on matrix properties). The gas pressure introduced in the MALDI ionization regions would similarly transmit all ions at approximately the same velocity (300 to 500 m/s). The mass dependent drift velocity in an electric field should not strongly exceed gas velocity. This requirement is consistent with the soft injection process. At a plate potential of ~10V and for gas pressure of 1 torr (mobility, K, is ~0.1 $m^2/Vs$), the average drift velocity ($v=kU/L$) will also remain substantially below 300 m/s and thus all mass components will be injected into the trap nearly simultaneously. The RF voltage is turned on or ramped up once the ions reach the vicinity of the center of the trap. The resulting quadrupolar field will create the trapping potential for retaining ions in the trap.

An important aspect of the present invention is that the trap parameters are chosen such that the collisionally cooled, trapped ion cloud is ideally designed for TOFMS analysis. As is known in the art, the resolution in TOFMS spectra is degraded by a spread in the spatial and the velocity distribution of the ions at the time of acceleration. Therefore, the invention allows the properties of ions in quadrupolar potentials to be used to maximize attainable resolution by confining the ion cloud tightly.

In the case of an RF only trap the motions of ions in quadrupolar fields are well known and described by the Mathieu equation. The stability of the harmonic trajectory of the ion in the quadrupolar field depends on Mathieu parameter, $q_u$, defined as $$q=-8zV_{rf}/m\Omega^2u_0^2$$

where $V_{rf}$ is the 0 to peak amplitude of an RF power supply with an angular frequency, $\Omega$, applied to the geometry with the field radius (in the coordinate u) of $u_0$, m and z are the mass and charge of ions. In the commonly used first stability region of the Mathieu equation, ions with $q<0.908$ have stable trajectories in the trap, i.e., ions with mass above the low mass cut off are confined in the trap. The q parameter also defines the position and energy of the ion in the trapping volume. For $q<0.4$, the motion of an ion can be approximated as a particle in harmonic potentials having the "pseudopotential" or "dynamic" well depth D as a function of distance to center r:

$$D(r)=qV_{rf}(u/u_0)^2/(8)^{1/2}$$

Typically, commercial ion traps have $u_0$ larger than 1 cm and radio frequency below 1 Mhz. In order to simultaneously trap ions with mass to charge ratios varying from 500 to 4000 (i.e., the typical requirement for peptide mass mapping applications) the preferred trap parameters are: $u_0$=5 mm, $V_{rf}$=5 kV and $\Omega=2\pi\times3$ MHz. These parameters differ from those of the conventional ion trap in order to provide a steeper trapping potential and thus tighter confinement of the ion cloud. Additionally, after collisional cooling is completed (typically after 10 ms trapping at a pressure of 0.1 millitorr), the energy distribution (at all depth of potentials) is close to thermal, and thus, at room temperature, the energy spread is ~0.03 eV, which corresponds to a velocity spread of 50 m/s for ions of mass 1 kDa. The spatial distribution in the segmented ion trap (i.e., the width of the ion cloud) is determined by the balance of thermal energy and the depth of RF potential. For ions with a Mathieu parameter q=0.1 (heaviest component in this example of m/z=4000), RF amplitude zero to peak of 5 kV, and field radius of the trap of 3 mm, the spatial spread is below 2*u ~0.05 mm. The product of spatial and velocity spreads in such a trap is lower than the best characteristics in DE MALDI, namely ~300 m/s velocity spread and 0.02 mm of non-correlated spatial spread (see Peter Juhasz et al. Journal of the American Society of Mass Spectrometry, 8, 1997). Hence the resolution of segmented trap-TOFMS should be comparable to, or better than, the resolution obtained in DE MALDI for the optimized mass range at or near threshold laser energy. The overall performance of the trap-TOFMS for this embodiment, however, is improved over that of DE-MALDI, as the trapped ions do not have a net component of velocity and, thus, resolution could be optimized for the entire mass range and mass calibration becomes a simple square root relation between mass and flight time.

The tight confinement of the beam may be altered by the space charge of the ion cloud. The potential created by space charge, $\Phi$, is approximated by $\Phi=Ne/4\pi\epsilon_o r$ where N is the number of trapped ions, e is the charge of electron, r is the radius of the ion cloud, and $\epsilon_o$ is the vacuum permeation constant. The inventors believe that the failure to maintain the three dimensional ion trap population at levels sufficiently low to minimize energy gain from space charge is one issue which has led to existing trap-TOFMS configurations to exhibit worse resolution than is predicted by theory. Therefore, trap capacity for illustrative purposes of the teachings of the present invention is calculated by equating the force of inter-ion repulsion with the thermal energy of the gas in the trap. The potential of the ion cloud with radius of r=05 mm will remain below thermal energy (0.026 eV) if the number of ions N in the trapping volume is below 10,000. The space charge is strongly reduced by choosing the parameters of the applied potential such that the low-mass cut-off is near m/z=500, which eliminates the matrix ions which carry most of the charge in MALDI. Considering that the trap holds analyte ions from a single laser shot, one can realize that the capacity of the trap is compatible with the yield of ion production in conventional DE MALDI. In DE MALDI the dynamic range of the mircochannel plate (MCP) detector for single laser shot is ~10,000 ions ($10^6$ channels with ~100 channels killed per ion in the second MCP plate). This is also confirmed by the typical settings for a transient recorder operated in counting mode, as an eight-bit transient recorder saturates when ion signal exceeds ~100 ions per isotope. Space charge effects become more pronounced if the laser is operated at higher energy as an increased ion count can also be achieved by operating the laser at a higher repetition rate. Techniques for dealing with such space charge effects will be further discussed subsequently in conjunction with the cooling rate and ion flux throughput.

An important result derived from the use of the invention is the achievement of a 100% duty cycle. The necessity to provide for an adequate time frame for collisional cooling is a constraint to take into account in determining the maximum possible repetition rate at which the instrument can be operated. In one commercially viable example, the pressure in the trap is varied from ~3 millitorr at the time of initiation of the gas valve pulse in the trap to ~0.1 millitorr at the time of ion extraction from the trap. For an ion with a mass of 1000 Da and a cross section of $\sigma=10^{-18}$ $m^2$, and a collision gas of nitrogen (m=28 Da) at 3 millitorr (gas density is $n=10^{20}$ $m^{-3}$ and thermal velocity v ~300 m/s), collisional cooling to thermal temperatures requires ~1 ms ($T\sim M/mn\sigma V$), and thus the corresponding maximum instrumental repetition rate is ~1000 Hz. Other factors to consider in determining the optimum repetition rate are the speed of gas evacuation out of the trap and the duration of gas valve pulse.

A further source of spectral degradation in TOF spectra known in the art is collisions between the ion and latent gas particles in the acceleration stage and in the TOFMS itself. These are minimized in accordance with one embodiment of the invention through the use of lower pressure in the trap at the ejection stage. The pressure reduction is achieved with the use of multiple stages of differential pumping, pulsed gas introduction, and small apertures. Specifically, as detailed in FIG. 3A, the end caps of the segmented ion trap serve as differential pumping apertures between the source, trap, and acceleration regions. The conductance through the ~1 mm diameter aperture is in the order of 0.1 L/s (10 L/s through 1 $cm^2$). In the MALDI source region, nitrogen is pulsed added to a pressure of 1 torr for the purpose of rapid stabilization of ions. Pulsed gas valves with 250 $\mu$s open time are available commercially from Parker Hannifin Corporation (Cleveland, Ohio). During application of the pulse the gas pressure in the trap would be defined by the pumping speed from the trap. The pumping speed is limited by conductance of a 1 cm diameter cell to a ~30 L/s vacuum pump, giving a 3 millitorr pressure pulse in the trap. After the pulsed gas introduction, the pressure drops as a ratio of the delay time and the duration of the pulsed valve opening. The desired pressure in the trap is 0.1 torr, corresponding to a mean free path of $\mu\sim1/n\sigma\sim30$ cm and thus the probability of scattering collisions in 5 mm trap is only 1.5%. The desired 0.1 millitorr pressure is achieved after 10 ms delay and thus the repetition rate of ejection in this example is limited to 100 Hz.

The pumping requirements downstream of the trap are less challenging. Since in the example above the ion cloud is confined to 0.1 mm and a uniform field is used for ion extraction, an aperture diameter of 1 mm is adequate for complete ion transmission. This corresponds to a gas flow of 0.1 L/s from the trap with a maximum peak pressure of ~3 millitorr and a minimum pressure of 0.1 millitorr. A single turbo pump with a moderate pumping speed of 250 L/s will maintain an acceptable pressure below $10^{-6}$ torr in the flight tube. By introducing an additional stage of differential pumping, for example, surrounding the DC acceleration stage, the gas pressure in the TOF analyzer could be maintained below $1\times10^{-7}$ torr, which is absolutely safe for TOFMS operation. If this second stage of differential pumping is added, the size of the exit aperture can be increased further, thereby ensuring a 100% ion extraction.

Earlier the space charge capacity for a typical three dimensional trap was estimated as 10,000 ions per cycle and it was found that a 100 Hz repetition rate can be achieved. These values define the throughput of the system which is equal to 1E+6 ions per second, which exceeds signals currently obtainable in DE MALDI.

The range of mass to charge ratios that can be simultaneously confined in the segmented ion trap is determined by the depth of the dynamic well. For the operating parameter discussed above, i.e., $u_O\sim5$ mm, $\Omega=3\times2\pi$ MHz and $V_{rf}=5000$ V, the Mathieu parameter of 100 kDa protein is q~0.002 and the depth of dynamic well, D, is 3 eV. Thus the maximum translational kinetic energy the ion can have and simultaneously be trapped is 3 eV, which corresponds to a translational velocity (again for the 100 kDa protein) of approximately 75 m/s. Such a velocity is prohibitively low for an ion formed by MALDI. To increase the dynamic well depth in order to trap higher mass MALDI ions, the frequency of the RF drive can be reduced, which will raise the q values across the mass range. Consequently, the upper and lower mass limits of the trap will be raised. For instance, if the frequency is lowered to 500 kHz, the 100 kDa ion will experience a well depth of 100 eV, and the lower mass cut off of the trap will be 20 kDa. A further consideration for high mass proteins with large collision cross sections is the occurrence of scattering collisions during the acceleration process. To minimize such collisions the gas pressure would have to be reduced by a factor of 100, which can be simply achieved by low frequency, pulsed introduction of the collision gas.

Figure 4A:
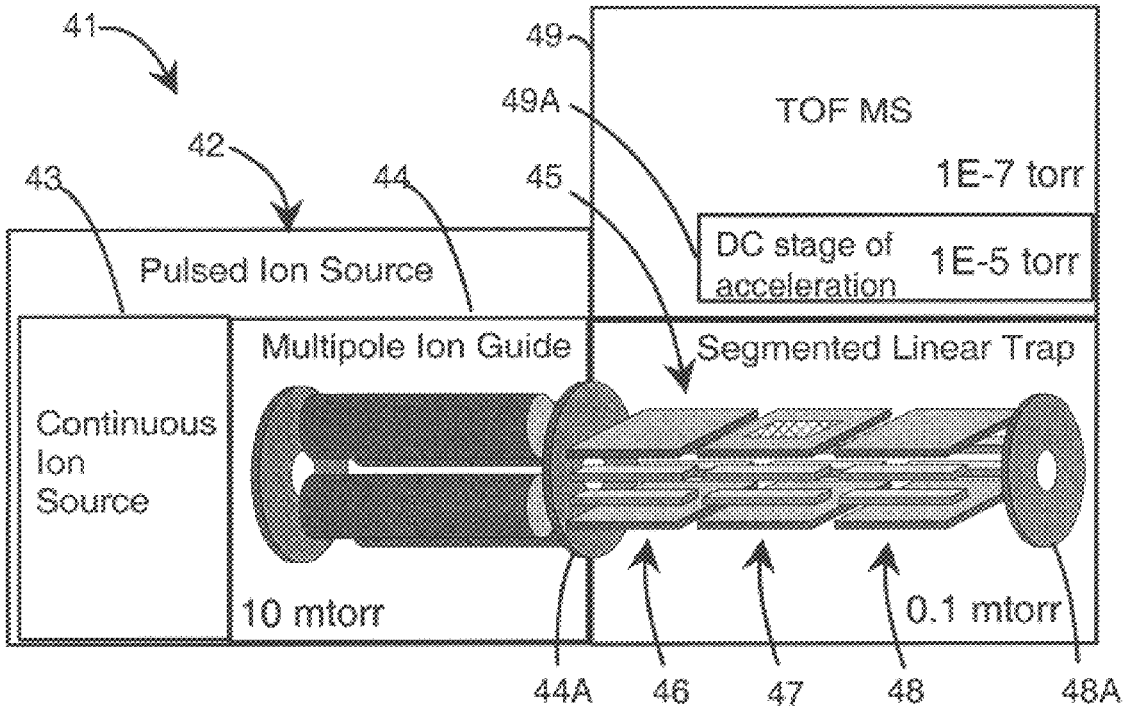
FIG. 4A is a schematic of an embodiment of the invention for use in ESI-TOFMS.

While the above description details one preferred embodiment for application to a pulsed ionization source, in this instance MALDI, the invention can be equally applied to continuous ionization sources, such as ESI. A preferred embodiment of the invention in application to continuous ionization sources is shown in FIG. 4A. The TOF analyzer for a continuous ion source 41 includes a pulsed ion source 42, a segmented linear trap 45 and orthogonally oriented TOF analyzer 49 with differentially pumped DC acceleration stage 49A. The pulsed ion source 42 is formed by a continuous ion source 43 and a multipole ion guide 44 with a modulating cap 44A. The linear trap 45 contains three sets of segmented traps 46, 47 and 48 and electrostatic end cap electrode 48A. The segmented linear ion trap helps minimize duty cycle losses typical in oa-TOFMS. In this embodiment of the invention, the multipole ion guide 44 behaves as a linear ion trap as described in the J. M. Campbell et al. reference cited above. In particular, the multipole ion guide can be used, with methods well known in the art, to store ions, to selectively eject ions of a specific mass to charge ratio or range of mass to charge ratios, and to fragment ions of a selected mass to charge ratio. Transmission of the stored ions from the multipole ion guide to the linear ion trap 45 of the TOFMS 47 is modulated by the potential applied to electrostatic cap 44A such that duty cycle loses are minimized.

Figure 4B:
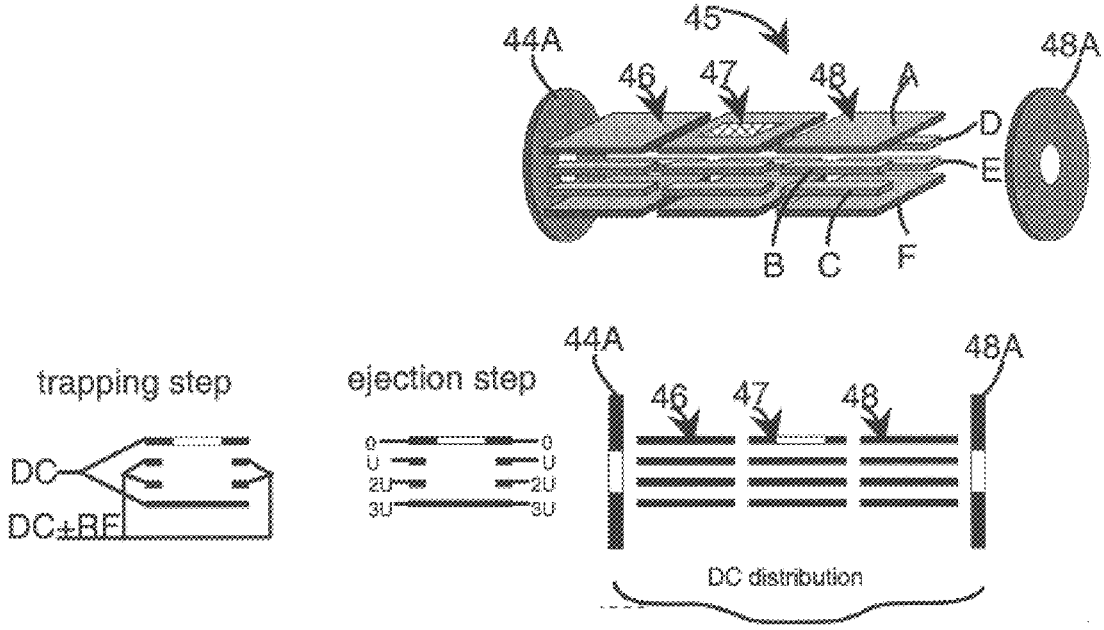
FIG. 4B is a schematic of a two-dimensional segmented ring ion trap used in the embodiment of FIG. 4A.

The details of the segmented ion trap of the TOFMS and the applied voltages for each mode of operation of the trap are shown in FIG. 4B. In the segmented linear ion trap, a two dimensional quadrupolar potential, well known in the art from mass filters and RF-only beam guides, is applied in cross beam direction, and electrostatic potentials confine the beam coaxial to the multipole. The trap itself 45 is formed by three segments 46, 47 and 48, each segment having six parallel plates (labeled A to F). The top (A) and bottom (F) plates are analogous to one pole pair in the mass filter. The four additional plates (B to E), in sets of two opposite each other, are analogous to the second mass filter pole pair. Although for the purpose of this embodiment of invention each plate is electrically isolated, when trapping is invoked opposite poles (B,C and D,E) have the same RF voltage applied, while adjacent poles have potentials which are of the same amplitude and frequency, but which are 180° out of phase. For this embodiment, the effective field radius of the trap is ~5 mm, and the length is 25 mm.

The trap 45 is formed from three segments and two end cap electrodes. The distribution of the electrostatic potential is shown in FIG. 4B. The electrostatic potential of the middle trap segment 47 is lower than those of both the first 46 and the third 48 trap segments, such that ions are confined in the middle segment 47. The potential offset of the middle trap segment 47 is also lower than that of the multipole ion guide 44 in order to promote the injection of ions into the segmented trap. Two electrostatic caps 44A and 48A assist trapping. The potential of the exit cap 48A is constant and held high to prevent ions from escaping. During ion injection, the potential of the entrance cap 44A is lowered for a short period of time (e.g., ~10 to 100 us). After the desired number of ions is injected, the potential of electrostatic cap 44A is raised again. Ions are dynamically trapped and oscillate within the linear trap. The RF potential is connected to the segmented linear trap for both ion injection and trapping. The kinetic energy of ions (in all coordinates) decreases via gas collisions with increased time of confinement in the multipole, and, eventually, ions precipitate near the axis of the middle trap segment 47. Dynamic trapping allows reduced gas pressure to be applied in the segmented linear ion trap, minimizing collisions during the extraction step. The parameters of the confined beam were estimated above. The combination of a ~50 m/s velocity spread and 0.05 mm radius of the pulse is an improvement over the comparable parameters in conventional oa-TOF, typically ~20 m/s velocity spread and 0.5 mm spatial spread.

After the collisional cooling step the ions are extracted from the linear trap through the narrow slit 47, covered with mesh, in the top electrode 45. For this extraction step, the RF is rapidly turned off and accelerating pulses are applied to the trapping electrodes such that a linear, unidirectional extraction field is created. This can simply be done by maintaining the top electrode at ground and applying a high voltage extraction pulse to the other electrodes, the magnitudes of which are proportional to the distance between the particular pulsed electrode and the top trap plate. The pulse of ejected ions is transferred to a differentially pumped acceleration region with a constant electric field and then transmitted into the TOF flight tube, which is equipped with a single stage ion mirror.

One major advantage of using the segmented trap-TOF combination in this embodiment is the ability to fully utilize the beam from the continuous ionization source, provided the throughput of the system is sufficient to handle this ion flow. The amount of time required for collisional cooling depends on the pressure in the trap region and is usually selected to maximize the repetition rate, without creating too high a gas load in the TOF system. At a pressure of 0.3 millitorr, cooling with a heavy gas occurs at ~10 ms, thus a repetition rate of 100 Hz is feasible. Another advantage of using the two dimensional trap structure of this embodiment is that the space charge capacity of the segmented linear trap is ~30 fold higher than that of the three-dimensional trap and thus approximately $3\times10^5$ ions could be contained in the trap without any significant effect on the energy distribution of ions. An ion flow of $3\times10^7$ ions/sec is approaching the maximum current achievable in an ESI system. In an attempt to increase ion flow to the maximum currently reported values of $3\times10^8$ ions/sec (50 pA) as specified in the API 3000 MS System (PE Biosystems, Foster City, Calif.), the pressure could be increased to ~1 millitorr and the trap may be elongated. If the higher pressure were used, it would be particularly advantageous to use either pulsed gas introduction, or an additional stage of differential pumping. If the conducting slit were a 1 by 25 mm rectangle, the gas flow through the slit would be ~3 L/s. Two stages of differential pumping, each pumped with a speed of 300 L/s, would result in a sufficiently low analyzer pressure of $\sim10^{-7}$ torr (i.e., 100 fold pressure reduction per stage that is equal to the ratio of pumping speed to the gas flow). While this high ion flow would result in the use of high speed, large memory data acquisition systems, it is possible to reduce the frequency of pulses to 100 Hz (from 10 kHz which is typical in oa-TOF). This will similarly decrease the load on averaging memory, hence a larger number of bits could be used in a transient recorder.

Another advantage of this invention over existing systems is that collisional cooling removes drift velocity i.e., the velocity component in the direction orthogonal to TOF acceleration. Consequently, there is only a minimal natural drift angle, and thus it is unnecessary to adapt the instrument for any post acceleration deflection of the beam, or a larger detector surface. As a result, a higher resolution can be attained with fewer steering elements and with a smaller detector surface.

The embodiment of the invention discussed above and shown in FIG. 4A could be easily applied to existing oa-TOFMS systems, such as the Qq-TOFMS or the LIT/TOFMS, where ions are fragmented prior to orthogonal acceleration. Similarly, the segmented ion trap could serve as the final trap in a multistage linear ion trap.

Figure 5A:
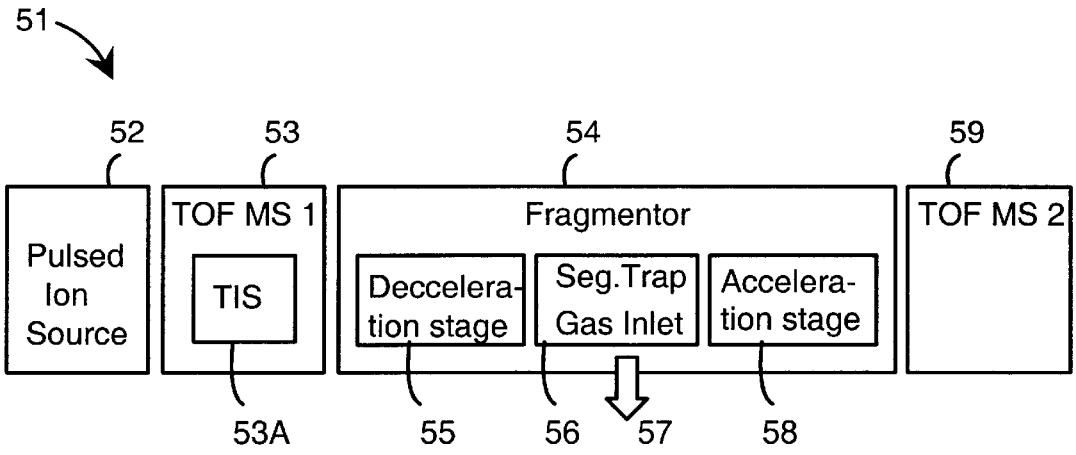
FIG. 5A is a block diagram of one embodiment of the invention used in TOF—TOF instrument systems.
Figure 5B:
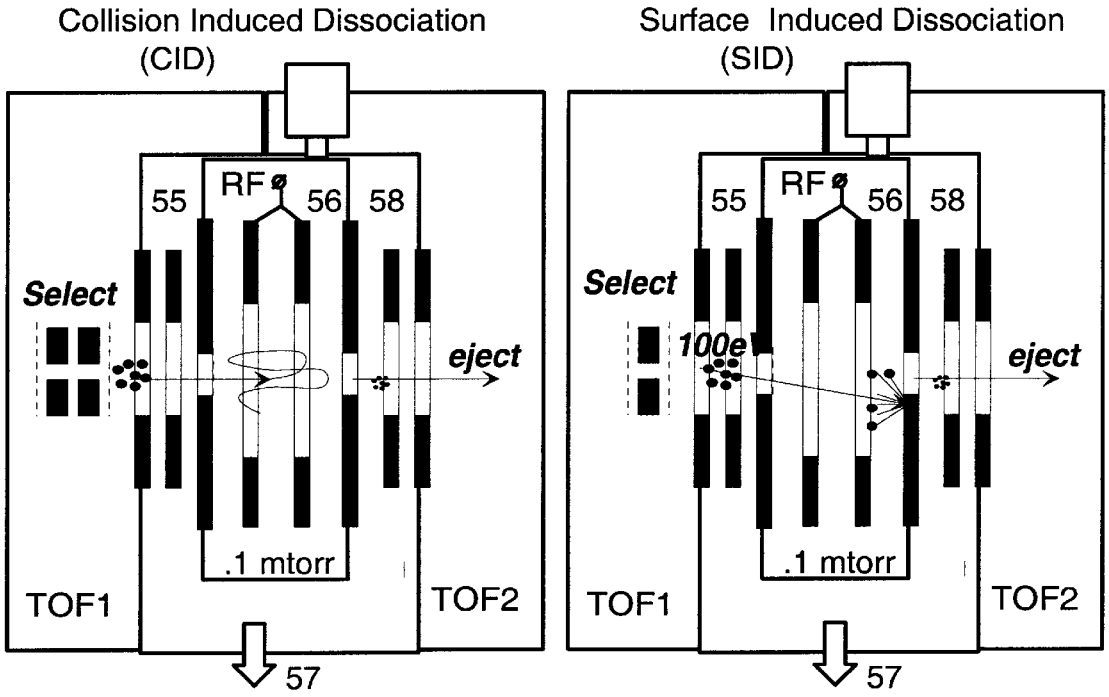
FIG. 5B is a schematic of the fragmentor used in the embodiment of FIG. 5A where the left panel is used for collision induced dissociation (CID) and where the right panel is used for surface induced dissociation (SID).

Another embodiment of the invention is concerned with the application of the principles of ion pulse preparation as applied to a tandem mass spectrometer, which in the preferred embodiment is constructed from two TOF based mass analyzers. The schematic diagram of this embodiment is shown on FIG. 5A. The tandem TOF mass spectrometer 51 includes a pulsed ion generator 52, a first TOF analyzer 53 for selection of primary ions by a timed ion selector 53A, a fragmentor 54 and a second TOF 59 for mass analysis of fragment ions. The pulsed ion generator comprises a pulsed ion source (such as MALDI) or a continuous ionization source (such as ESI) with orthogonal injection into the source region of a first TOFMS 53 or by injection using the storing ion trap as previously described. The fragmentor 54 includes a deceleration lens stack 55, a segmented trap with the gas inlet system 57, an acceleration stage 58 and a differential pumping system 57 with two stages 55 and 58. The geometry of the fragmentor used in this embodiment is shown in FIG. 5B, which depicts two techniques wherein low energy fragmentation is induced by collisions between the ion and a neutral gas (left panel) or a surface (right panel).

In operation, a pulse of ions is produced by the ion generator 52 and injected into the first (linear) TOF 53 (TOF1). Velocity based separation of the precursor ion is achieved using the timed ion selector 53A situated at the focal plane of TOF1 53. The timed ion selector can be of various types well known in the art such as a single pulsed gate (e.g., a Bradbury Nielsen gate) or a single deflection gate. Selected ions are decelerated in the lens stack 55, such that low energy metastable ions can be filtered out before entering the fragmentor. Additionally the decelerating lens stack can be used to adjust the collision energy. Mass selected ions enter the three-dimensional segmented ring trap 56 of the fragmentor 54 as a well focused pulse (in space, a <1 mm spread and in time, a <100 ns spread). In the case of CID fragmentation (FIG. 5B left panel) ions are dynamically trapped when they reach the center of the trap by turning on or ramping up the RF potential. Dynamically trapped ions continue oscillating within the trap at the same kinetic energy. The trap is filled with gas at ~0.1 millitorr pressure via a gas inlet system. Although a fixed gas pressure can be used, in this embodiment, the gas is introduced via a pulsed valve and gas pulses are synchronized with ion production in the source. Trapped ions collide with the background gas and have a single collision per several passes. Excited ions slowly dissociate within the trap and lose kinetic energy in gas collisions. In ~10 ms ions lose sufficient kinetic energy to be effectively confined in the center of the trap. After completing the cooling step, the product ions are extracted as pulses into the second TOF (TOF2) for mass analysis. In the case of surface induced dissociation SID (FIG. 5B right panel), ions are directed onto a back wall of the trap, collide with the surface and bounce off with ~1 eV kinetic energy. Fragments and internally excited precursor ions are trapped dynamically with subsequent cooling and extraction into TOF2. In either case, ion confinement is achieved using the three-dimensional segmented ring ion trap shown and described with respect to the embodiment of FIG. 3B. The implementation of dynamic trapping with collisional cooling as a method of pulse preparation, is analogous in operation to the previously described trap in MALDI-TOF applications. The improvements to the spectrum are as discussed above. The estimated velocity and spatial spreads of 50 m/s and 0.05 mm respectively are substantial improvements over comparable parameters in existing tandem TOF instruments, namely 1000 m/s and ~1 mm.

In most existing TOF-CID-TOF instruments, ions are transmitted with high kinetic energy through the collision cell with a relatively small loss of energy and a finite probability of single collision with gas. The internal energy available in such a configuration is a small fraction of the kinetic energy of injected ions. In this embodiment, the kinetic energy is fully absorbed in multiple collisions and thus low kinetic energy (~50 eV/1 kDa) is used at injection.

In TOF-TOF instruments such as that described in U.S. patent application Ser. No. 09/233,703, the translational kinetic energy is in the kilovolt regime and thus the kinetics of dissociation are expected to be rapid. However, those rapid channels mostly produce multiple stage fragmentation and small fragments carry limited structural information. The larger mass, structurally informative fragments are typically created in the 10 to 100 $\mu$s time scale. In current TOF-TOF and SID-TOF instruments such fragments are observed in TOF2 as metastable peaks. Whether or not the fragments are detectable is in part related to the kinetics of dissociation. In the present invention, the time available for fragmentation increases, hence the fragmentation efficiency in the trap increases and metastable fragmentation in TOF2 would become negligible. For example, at a storage time in the trap $T_{TRAP}$=10 ms and a flight time in TOF2 $T_{TOF}$=0.1 ms, the in flight fragments can not exceed $T_{TOF}/T_{TRAP}$, which is 1%.

The issue of trapping in the quadrupolar field yields special consideration in the tandem embodiment of the invention. Dynamic trapping of ions requires that the translational kinetic energy of the ions in the direction of acceleration is lower than the depth of the trapping well in that coordinate. Additionally, for tandem mass spectrometry it is necessary to trap a broader mass range of fragment ions. Ideally, the mass range of the trap should extend from 100 Da to 2000 Da, such that both low mass immonium fragment ions and the precursor ions can be simultaneously trapped. The stability criterion that q<0.908, required for all of these conditions to be met, dictates that the RF drive must be operated with higher amplitude and angular frequency than conventional ion trap technology. For example, a peptide ion with a mass of 2 kDa and 150 eV of translational kinetic energy could be trapped with an applied RF potential having a zero to peak amplitude of 5 kV. The mass range could be further increased by introducing a segmented linear ion trap aligned along the beam with a ~100 millitorr pressure. The fragments would be thermalized in a single pass through such a cell. The resultant fragments could be pulse injected into the subsequent trap for ion beam preparation, followed by TOF analysis as shown on FIG. 2A or an ortho-TOF as shown on FIG. 4A.

Another embodiment of the tandem TOF instrument makes use of SID rather than CID for precursor ion activation. For details of this embodiment of the invention, reference is made to FIG. 6A. The methods of ion formation and precursor ion selection are as shown in FIG. 5A. For SID, ions are substantially decelerated as they enter the fragmentor and are electrostatically focused (at an angle) onto an inert surface such as gold, covered with a monolayer of an organic substance such as ethanioate. Such a surface is known in the art to promote SID by reducing ion losses and emission of secondary ions of the surface material and by enhancing the conversion of translational kinetic energy to internal ion energy. The efficiency of this conversion is known in the art to be 10–40%, depending on the nature of the surface, the ion, and the impact energy. Ions that impinge on the surface with energy of 50 to 100 eV will gain ~10 to 40 eV internal energy and 0.2 to 1.0 eV kinetic energy. One advantage of SID is that the increase in internal energy is substantially lower than the activation energy required in CID, leading to greater control over the accessible fragmentation channels in MS/MS. Furthermore, the SID scheme provides an efficient method of absorbing the primary kinetic energy of ions and simplifies trapping of secondary ions, usually emitted with ~1 eV (or less) energy.

The embodiment of the instrument utilizing the SID technique, shown in FIG. 5B, operates as follows. The precursor ions are admitted into the cell and strike the specially coated probe in the back wall of the fragmentor. The surface collision event is well defined in time as ions are time focused and time selected in TOF1. At gas pressures below 1 millitorr the effect of gas collisions in the cell is negligible and primary energy deposition is defined by the SID process. The excited precursor ions (with a minor degree of fragmentation) are repelled from the probe by a low potential (typically a few volts) and travel within the trap for 3 to 10 μs. After ~1 μs delay after the collision, the RF amplitude is ramped up to trap fragment ions. Ions are stored for sufficient time (~10 ms at 0.3 millitorr) to undergo slow fragmentation and to be collisionally confined.

Figure 6A:
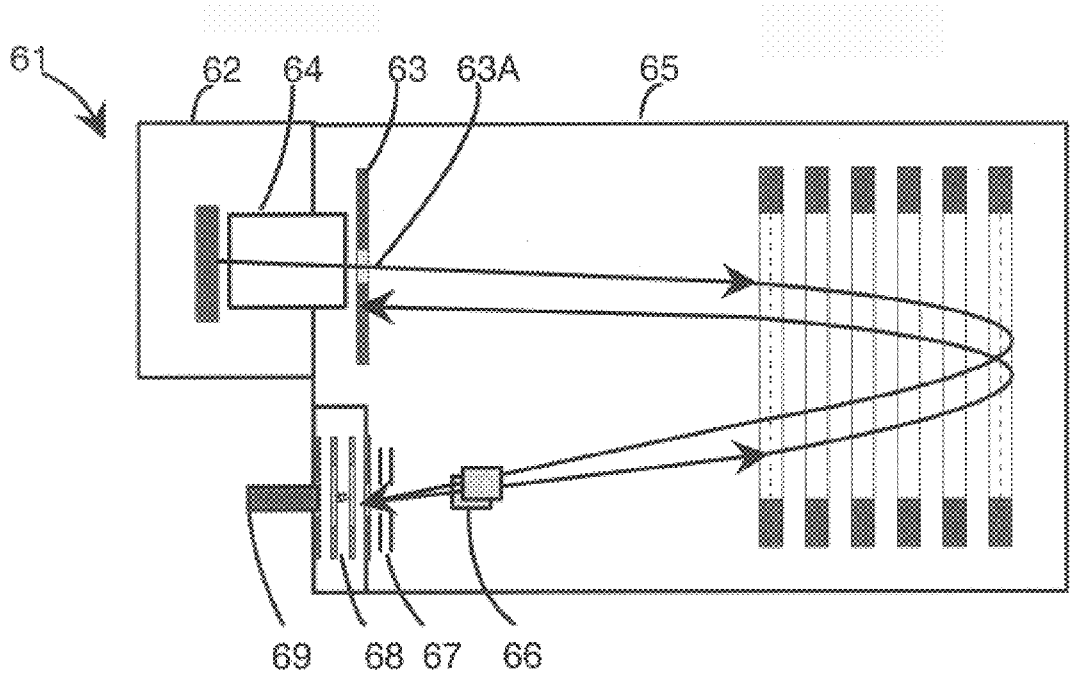
FIG. 6A is a schematic of one embodiment with folded TOF—TOF geometry and with a SID/CID fragmentor.

Referring to FIG. 6A, a further embodiment of the invention is a TOF/TOF instrument using SID or low energy CID in the fragmentor. This instrument, termed the folded geometry TOF/TOF, has the same geometry as the single MALDI instrument shown in FIG. 3A. However, in the folded geometry configuration the same TOF mass analyzer volume is used for both stages of tandem MS analysis.

Figure 6B:
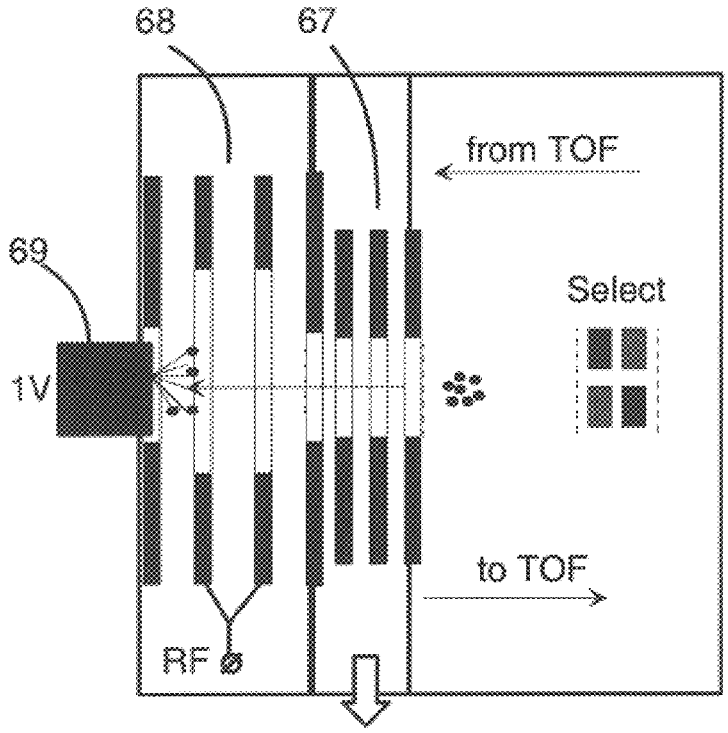
FIG. 6B is a schematic of the SID/CID fragmentor of the TOF—TOF of the embodiment of FIG. 6A.

In operation, ions are extracted from the source 62, which may be either a MALDI source or a continuous ionization source with orthogonal injection, through an annulus 63A in a microchannel plate 63 situated after the acceleration region 64. From the acceleration region ions are injected into a reflecting TOF 65 at a small angle to the axis. After separation in time in the TOF, ions are selected by a timed ion selector 66, pass through a decelerating lens 67, and enter the fragmentor 68. The SID fragmentor in this embodiment is the same as described and shown in the FIG. 6B embodiment. It includes the electrode configuration as described for the three-dimensional segmented ions trap, enclosed within a housing with a single differential pumping aperture to the TOFMS 65. At the back wall of the fragmentor, a probe 69 with small metal surface coated with a monolayer of a surface known in the art to promote SID activation. Pressure in the fragmentor is maintained at 0.1 to 1.0 millitorr, through the addition of a pulsed neutral gas. The pulse is triggered prior to ion pulse injection. As there is only one aperture in the fragmentor, the load on the pumping system is reduced relative to the embodiment shown in FIG. 6A. The activated ions are directed to the center of the fragmentor and the RF is rapidly turned on such that the precursor is confined in a collisional environment for 1 to 10 ms. Through collisional cooling these ions are stabilized and confined to the low field region near the center of the quadrupole trap. After complete cooling of the pulse (1 to 100 μs) the precursor and fragments are ejected out of the trap by applying a high voltage pulse of opposite polarity on the trap electrodes. The pulse is axially injected into the same reflecting TOF in the reverse direction of its transmission. Ions are directed onto the detector surface 63 in front of the acceleration region 64.

The folded geometry configuration is also readily applicable to tandem mass spectrometry with collisionally induced dissociation (CID). In this case ions are dynamically trapped in the fragmentor 68 before they reach the SID probe. In dynamically trapped ions, kinetic energy is slowly converted to internal energy through gas collisions and experience decomposition with subsequent cooling and pulsed ejection into the TOF.

The publications referred to herein are hereby incorporated by reference to the extent that each is relied upon for the understanding of the various described embodiments of the invention.

What is claimed is:

1. A tandem time-of-flight mass spectrometer comprising:

(a) a pulsed ion source;

(b) a first time-of-flight mass spectrometer connected to the ion source for selecting pulses of precursor ions for further analysis;

(c) a fragmentor in communication with the first time-of-flight mass spectrometer for receiving the pulses of precursor ions and dissociating at least a portion of the precursor ions into fragment ions;

(d) an ion trap in communication with the fragmentor for receiving pulses of precursor and fragment ions;

(e) a power supply coupled to the ion trap providing RF and DC voltages to the ion trap for dynamically trapping and confining the pulses of precursor and fragment ions;

(f) a gas supply for regulating the pressure within the trap to produce collisional cooling of the precursor and fragment ions confined therein;

(g) a source of pulsed voltages applied to the ion trap for extracting pulses of precursor and fragment ions from the trap; and (h) a second time-of-flight mass spectrometer receiving the extracted pulses of ions.

2. The mass spectrometer of claim 1 wherein the ion source comprises a matrix assisted laser desorption/ionization ion source (MALDI).

3. The mass spectrometer of claim 2 wherein the MALDI source includes a laser operating at a high repetition rate and at an energy of at least two times higher than the threshold energy required for ion production.

4. The mass spectrometer of claim 1 wherein the gas supply includes a pulsed gas valve producing sub-millisecond bursts of gas such that ion source pressure is in the range of from 0.1 to 1 torr, the bursts of gas being synchronized with the pulses of ions produced from the ion source.

5. The mass spectrometer of claim 2 wherein the MALDI source includes an infrared laser for generation of stable ions, the source being operated at the same pressure as the ion trap.

6. The mass spectrometer of claim 1 wherein the pulsed ion source comprises a continuous ion source selected from the group of nanospray, ESI, CI, EI sources or a quasi continuous ion source in the form of a MALDI source with a high repetition rate laser and further comprising a storing, RF-only multipole guide for intermediate storage of the continuous ion beam and for ejection of ion pulses.

7. The mass spectrometer of claim 6 wherein the multipole ion guide is operated as a linear ion trap, being used for selective ion isolation, ejection, and/or fragmentation, and thus providing an additional stage of multi-step MS analysis.

8. The mass spectrometer of claim 6 wherein the RF-only multipole ion guide is a portion of a tandem mass spectrometer including a linear trap or a quadrupole filter for precursor ion mass selection.

9. The mass spectrometer of claim 1 wherein the ion trap comprises four electrically isolated ring electrodes, with the two middle electrodes being connected to a high voltage RF power supply, and the outer two rings being connected to ground such that a substantially three dimensional quadrupolar field is created for trapping ions.

10. The mass spectrometer of claim 1 wherein the ion trap is a two-dimensional segmented trap formed by three quadrupole sets, each containing 6 rectangular plates configured parallel in space wherein the two opposite electrodes of every set are connected to one pole of the RF power supply and two pairs of opposite electrodes are connected to the other pole of the RF power supply, and wherein the DC power supply is connected between the quadrupole sets, thereby creating a two-dimensional quadrupolar field with ions trapped in the axial direction by an electrostatic offset between quadrupole sets, whereby ions are injected into the linear segmented trap either axially or orthogonally through a window in the electrode.

11. The mass spectrometer of claim 1 wherein the RF and DC voltages are turned on or ramped up at the time when injected ions reach the center region of the ion trap.

12. The mass spectrometer of claim 1 wherein the gas used to fill the trap at the time of ion ejection is helium, and the ion source is maintained at a gas pressure between 0.1 and 1 millitorr.

13. The mass spectrometer of claim 1 wherein the gas used to fill the trap at the time of ion ejection is a gas other than helium, and the ion source is maintained at a gas pressure between 0.1 and 1 millitorr.

14. The mass spectrometer of claim 1 wherein the RF power supply provides an RF signal with amplitude above 1 kV and frequency above 1 MHz to provide tight confinement of the trapped ions.

15. The mass spectrometer of claim 1 wherein the ion trap volume is equal to or lower than 1 $cm^3$ to produce tight confinement of the ion beam.

16. The mass spectrometer of claim 1 wherein the pulsed ion source is coupled to the first TOF MS by a segmented ion trap.

17. The mass spectrometer of claim 1 wherein the fragmentor is a three dimensional ion trap comprising four electrically isolated ring electrodes, with the two middle electrodes being connected to a high voltage RF power supply, and the outer two rings being connected to ground such that a substantially three dimensional quadrupolar field is created for trapping ions.

18. The mass spectrometer of claim 1 wherein the fragmentor is a two-dimensional ion trap comprising three quadrupole sets, each containing six rectangular plates configured parallel in space wherein the two opposite electrodes of every set are connected to one pole of the RF power supply and two pairs of opposite electrodes are connected to the other pole of the RF power supply, and wherein the DC power supply is connected between the quadrupole sets, thereby creating a two-dimensional quadrupolar field with ions trapped in the axial direction by an electrostatic offset between quadrupole sets and wherein the second time-of-flight analyzer is oriented orthogonal to the axis of the first time-of-flight analyzer.

19. The mass spectrometer of claim 1 wherein the first time-of-flight analyzer is a linear analyzer.

20. The mass spectrometer of claim 1 including a timed ion selector in the first time-off-light analyzer comprising two pairs of deflection plates located in a field free region between the ion source and the fragmentor, the first pair deflecting light ions and the second pair deflecting heavy ions.

21. The mass spectrometer of claim 1 wherein precursor ion selection is accomplished by a single pulsed gate such as a Bradbury Nielsen gate or a single deflection gate.

22. The mass spectrometer of claim 1 wherein each of the first and second time-of-flight analyzers includes a free flight region whose potential is floated and the ion source and the ion trap are held near ground potential.

23. The mass spectrometer of claim 1 wherein a neutral gas is added to the volume of the fragmentor using a pulsed valve synchronized with the arrival of the ions in the fragmentor.

24. The mass spectrometer of claim 1 wherein a neutral gas is added to the volume of the fragmentor continuously such that fragmentor pressure and is sustained below 1 millitorr to avoid scattering collisions during ion ejection.

25. The mass spectrometer of claim 1 wherein the fragmentor includes a probe coated with a polymer known to promote surface induced dissociation and configured such that precursor ions undergo low energy collisions with the probe.

26. The mass spectrometer of claim 1 wherein the DC potential of the ion trap is adjusted to control the kinetic energy of ions injected into the ion trap.

27. A method of analysis by tandem mass spectrometry comprising the steps of:

(a) using a first time-of-flight mass analyzer to select pulses of precursor ions;

(b) fragmenting at least a portion of the precursor ions;

(c) confining the pulsed precursor and fragmented ions in an ion trap;

(d) regulating the pressure of a gas supplied to the ion trap to produce collisional cooling of the ions confined therein; and (e) directing the collisionally cooled ions from the ion trap to a second time-of-flight mass analyzer for further analysis.

28. The method of claim 27 wherein the ion pulses are produced from a matrix assisted laser desorption/ionization ion source.

29. The method of claim 27 wherein the gas is supplied to the ion trap by a pulsed gas valve synchronized with the production of ion pulses.

30. The method of claim 27 wherein the ion pulses are produced from a continuous ion source selected from the group of nanospray, ESI, CI or EI sources or a quasi continuous ion source in the form of a MALDI source with a high repetition rate laser and further comprising a storing, RF-only multipole guide for intermediate storage of the continuous ion beam and for ejection of ion pulses.

31. The method of claim 30 wherein the multipole ion guide is operated as a linear ion trap, being used for selective ion isolation, ejection, and/or fragmentation.

32. The method of claim 27 wherein the confining step includes applying RF and DC voltages to the ion trap at the time when injected ions reach the center of the ion trap.

33. The method of claim 32 wherein an RF signal with amplitude above 1 kV and frequency above 2 MHz is applied to provide tight confinement of the trapped ions.

34. The method of claim 27 wherein the fragmentor is a three dimensional ion trap comprising four electrically isolated ring electrodes, with the two middle electrodes being connected to a high voltage RF power supply, and the outer two rings being connected to ground such that a substantially three dimensional quadrupolar field is created for trapping ions.

* * * * *